US006112526A

United States Patent [19]

Chase

[11] Patent Number: 6,112,526

[45] Date of Patent: Sep. 5, 2000

[54] TOWER MOUNTABLE CRYOCOOLER AND HTSC FILTER SYSTEM

[75] Inventor: David Chase, Santa Barbara, Calif.

[73] Assignee: Superconductor Technologies, Inc., Santa Barbara, Calif.

[21] Appl. No.: 09/217,504

[22] Filed: Dec. 21, 1998

[51] Int. Cl.[7] ..... F25B 9/00; F25D 23/12

[52] U.S. Cl. ..... 62/6; 62/259.2

[58] Field of Search ..... 62/6, 259.2, 51.1

[56] References Cited

U.S. PATENT DOCUMENTS 4,079,595 3/1978 Kroebig ..... 62/6
4,138,847 2/1979 Hill ..... 60/508
4,387,762 6/1983 Rinderle ..... 165/1
4,722,188 2/1988 Otters ..... 60/517
5,811,816 9/1998 Gallagher et al. ..... 250/370.15

*Primary Examiner*—William Doerrler
*Attorney, Agent, or Firm*—Lyon & Lyon LLP

[57] ABSTRACT

An improved HTSC filter system design. An improved HTSC filter system comprises a cryocooler and dewar assembly, a heat dissipation assembly and at least one heat pipe providing a thermal coupling between said heat dissipation assembly and said cryocooler and dewar assembly. In a preferred embodiment, the cryocooler and dewar assembly is environmentally sealed within a double-walled aluminum canister, and the heat pipes are formed from stainless steel tubes having a predetermined amount of ammonia provided therein.

21 Claims, 3 Drawing Sheets

TOWER MOUNTABLE CRYOCOOLER AND HTSC FILTER SYSTEM

FIELD OF THE INVENTION

The present invention relates generally to high temperature superconducting (HTSC) filter systems for use in, for example, cellular PCS systems and, more particularly, to tower mountable HTSC filter systems and enclosures.

BACKGROUND OF THE INVENTION

Recently, substantial attention has been devoted to the development of high temperature superconducting radio frequency (RF) filters for use in, for example, cellular telecommunications systems. However, such filters are extremely temperature sensitive, and the use of such filters within tower mounted communications systems can raise significant heat management issues.

One such issue, is the issue of cryocooler "cold finger" temperature regulation, which is addressed in co-pending, U.S. patent application Ser. No. 09/204,897, on Dec. 3, 1998 and entitled "TEMPERATURE CONTROL OF HIGH TEMPERATURE SUPERCONDUCTING THIN FILM FILTER SUBSYSTEMS," the disclosure of which is incorporated herein by reference.

However, another equally important issue, and one that is addressed herein, is the issue of heat dissipation. Stated somewhat differently, for an HTSC filter system to function properly, the heat of compression generated by a cryocooler incorporated within the system must be efficiently and reliably rejected to the ambient environment. If that heat cannot be efficiently and reliably rejected, it may have a serious impact upon system operation and, depending upon the circumstances, could result in inefficient cryocooler operation and/or cryocooler shut down.

Those skilled in the art also will appreciate that, when multiple HTSC filters are deployed, for example, within a dewar cooled by a cryocooler, and the cryocooler is mounted, for example, on a telecommunications tower, substantial durability and reliability issues may arise. For example, when a system is to be mounted at the top of a tower, the system must be able to withstand significant changes in climate and weather, and the system must be reliable and require minimal maintenance. In this latter regard, reliability can be improved, and maintenance requirements reduced, through the use of a minimal number of moving parts. Thus, where a cryocooler and associated HTSC filter system are to be mounted atop a tower, it would be desirable to utilize a cryocooler including as few moving parts as is possible. Similarly, any associated heat management system should include a minimum number of moving parts.

In view of the foregoing, it is believed that those of ordinary skill in the art would find an improved system for "managing" the heat of compression generated by a cryocooler within a tower-mounted HTSC filter system to be quite useful. It also is believed that those skilled in the art would find a tower-mounted HTSC that is highly reliable and utilizes a minimum number of moving parts to be useful.

SUMMARY OF THE INVENTION

The present invention is directed to an improved heat management system and design for a tower-mounted HTSC filter system.

In one particularly innovative aspect, a tower-mounted HTSC filter system in accordance with the present invention utilizes a plurality of heat pipes to carry heat away from a cryocooler body to a finned heat dissipation assembly. Moreover, an HTSC filter system in accordance with the present invention may comprise a environmentally sealed housing having, for example, a Stirling cycle cryocooler and dewar assembly mounted therein, a heat dissipation assembly coupled to a selected surface of the environmentally sealed housing, and a plurality of heat pipes providing a thermal coupling between the heat dissipation assembly and one or more heat rejecting blocks of the cryocooler.

In a presently preferred embodiment, the heat pipes comprise sealed stainless steel tubes that are filled with ammonia, and the environmentally sealed housing comprises a double-walled aluminum cylindrical container.

Other objects and features of the present invention will become apparent from consideration of the following description taken in conjunction with the accompanying drawings.

DETAILED DESCRIPTION OF PREFERRED EMBODIMENTS

Figure 1:
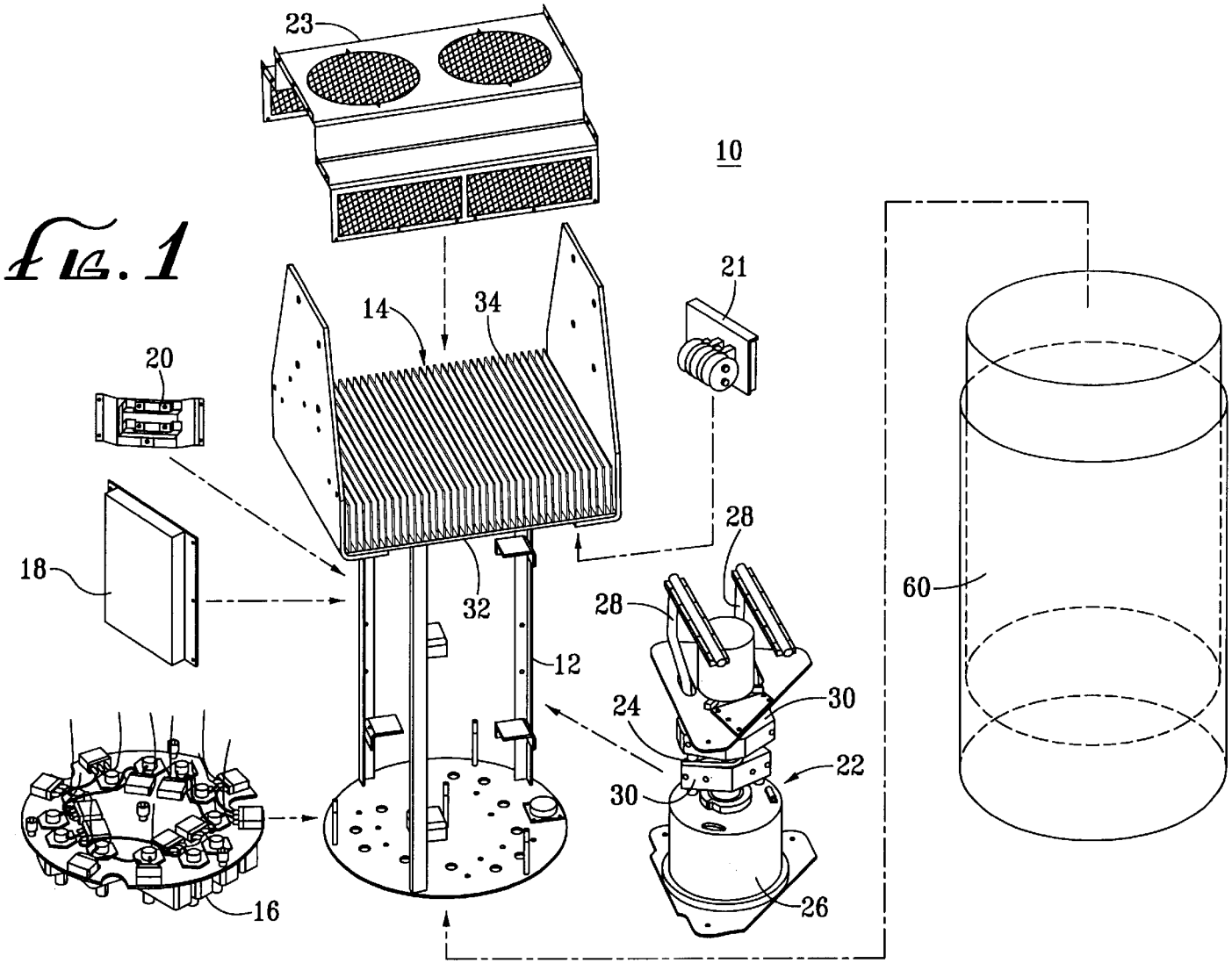
FIG. 1 is an exploded view of a tower-mountable HTSC filter system in accordance with the present invention.

Turning now to the drawings, FIG. 1 provides an exploded illustration of a tower mountable HTSC filter system 10 in accordance with a preferred form of the present invention. As shown, the HTSC filter system 10 includes a frame 12; a heat dissipation assembly 14; an electronics plate assembly 16; a controller assembly 18; a lightning protector assembly 20; a capacitor assembly 21; and a cryocooler, dewar and heat pipe assembly 22.

Preferably, the heat dissipation assembly 14, electronics plate assembly 16, controller assembly 18, lightning protector assembly 20, capacitor assembly 21, and cryocooler, dewar and heat pipe assembly 22 are mounted to the frame 12, and the resulting subassembly is mounted within a housing or canister 60. Further, in some embodiments, it may be desirable for the HTSC filter system 10 to further include, as part of the heat dissipation assembly 14, a screened enclosure 23 including one or more fan units (not shown). However, the HTSC filter system 10 has been found to perform adequately without requiring the use of such fan units.

The cryocooler, dewar and heat pipe assembly 22 comprises, for example, a Stirling cycle cryocooler unit 24, such as that described in co-pending U.S. patent application Ser. No. 09/175,924, which is entitled "Cryocooler Motor with Split Return Iron" and is hereby incorporated by reference; a dewar assembly 26 coupled to the cryocooler unit 24; and a plurality of heat pipes 28. Those skilled in the art will appreciate that the dewar assembly 26 preferably includes a heat-sink (not shown) whereon a plurality of HTSC filters (not shown) may be mounted. Such a heat-sink is shown, for example, in co-pending U.S. patent application Ser. No. 09/204,897 entitled "TEMPERATURE CONTROL OF HIGH TEMPERATURE SUPERCONDUCTING THIN FILM FILTER SUBSYSTEMS," which was filed on Dec. 3, 1998, and is referenced above.

The heat pipes 28 preferably are formed from stainless steel tubing and have a predetermined amount of ammonia provided therein. The heat pipes 28 provide a thermal coupling between the heat dissipation assembly 14 and one or more heat rejector blocks 30 provided on an exterior of the cryocooler unit 24. It will be appreciated that the heat pipes 28 provide an efficient means for moving excess heat away from the cryocooler unit 24 and for delivering that heat to the heat dissipation assembly 14.

The heat dissipation assembly 14 preferably comprises a base plate 32 and a plurality of vertically oriented fins 34. The base plate 32 and fins 34 preferably are formed from aluminum alloy and have high thermal conductivity. In addition, the base plate 32 preferably has a heat pipe mounting section (not shown) that is inclined 7° with respect to horizontal. The heat dissipation assembly 14 also preferably is chemically treated to improve its resistance to environmental factors such as precipitation.

Figure 2:
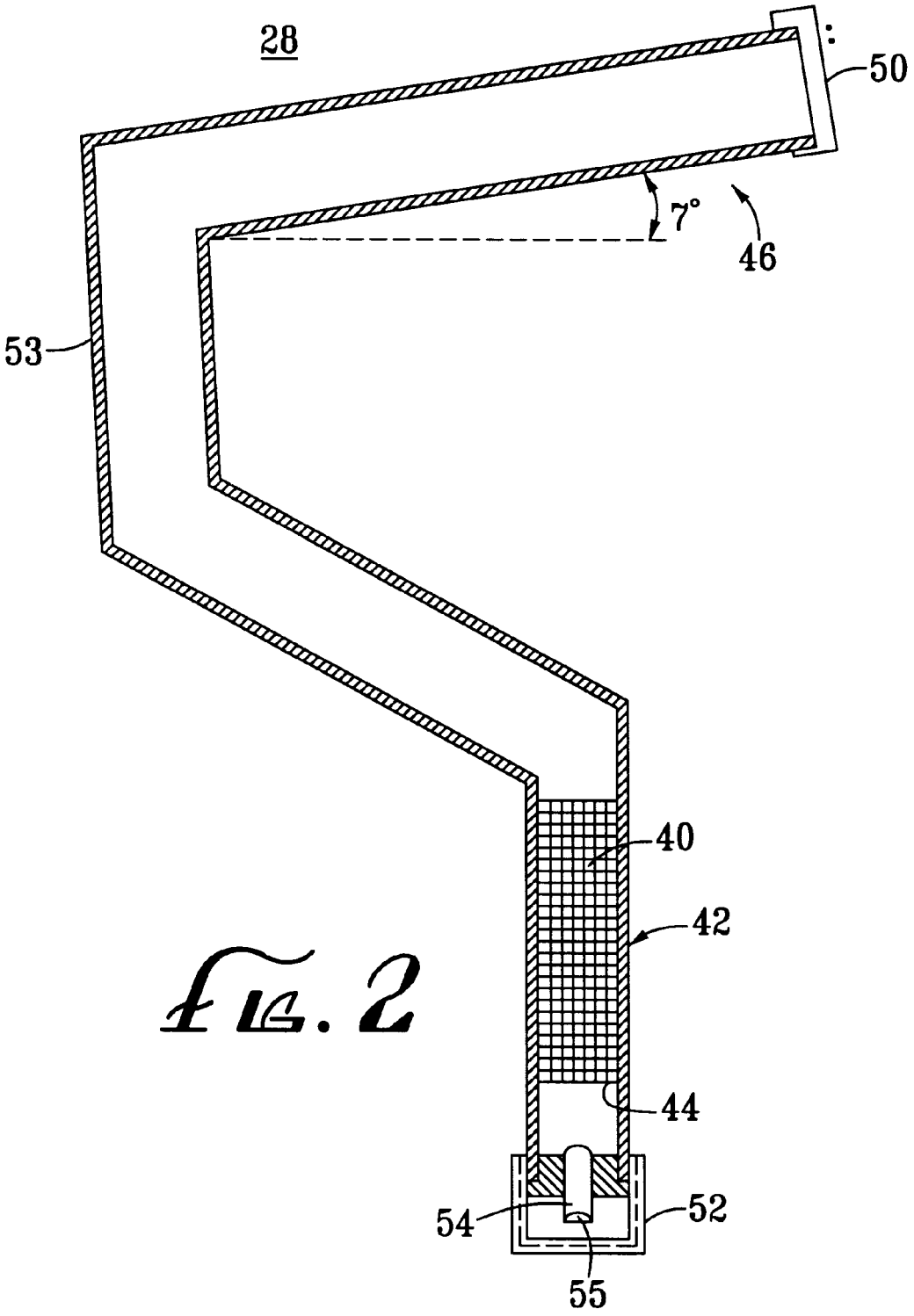
FIG. 2 is a cross-sectional view of a heat pipe in accordance with the present invention.
Figure 3:
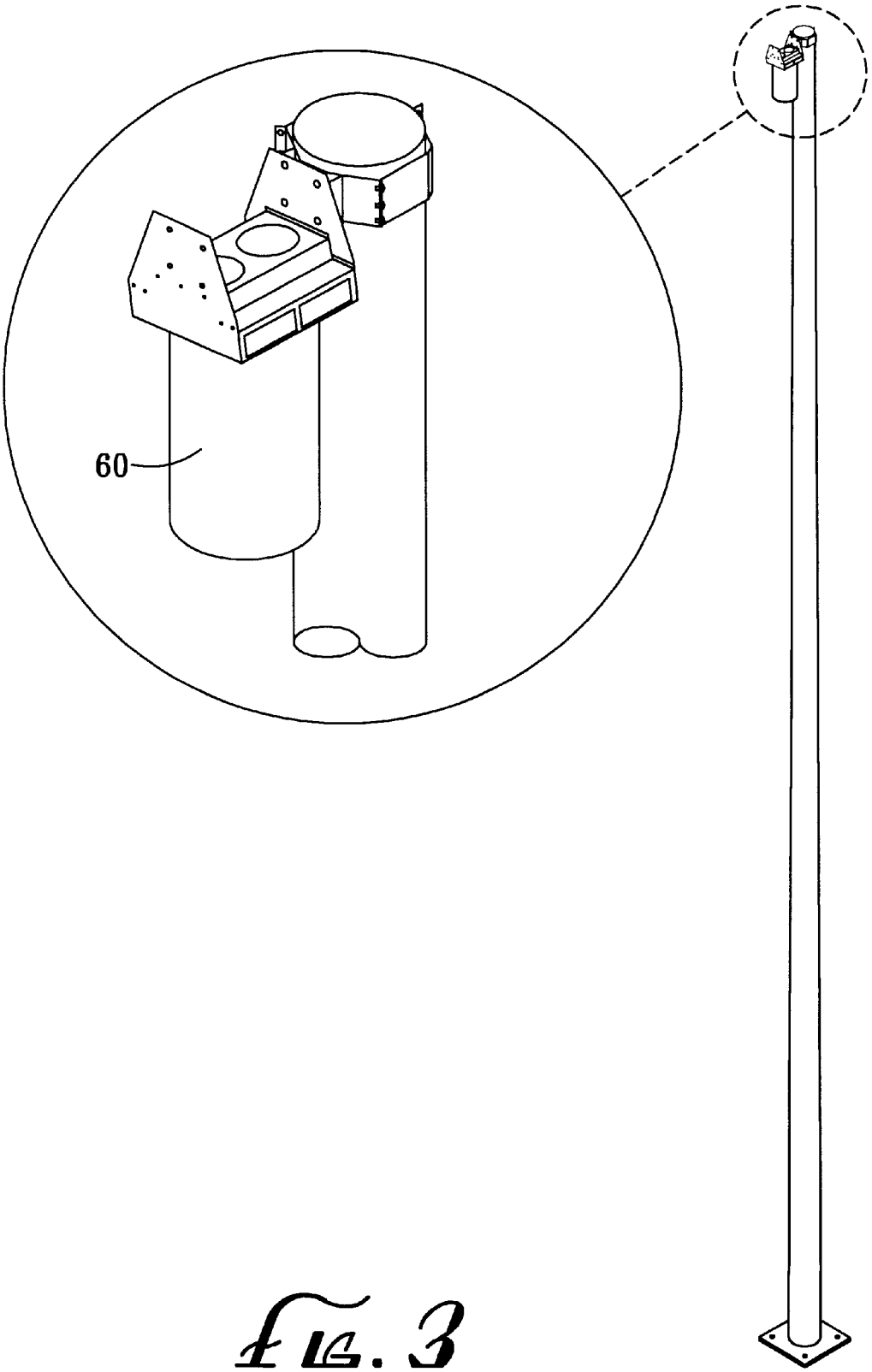
FIG. 3 illustrates how the HTSC filter system of FIG. 1 may be mounted, for example, on a telephone pole or other tower.

Turning now to FIG. 2, the heat pipes 28 preferably have a wire mesh 40, or similar structure, provided within an evaporator end 42 thereof. The wire mesh 40 preferably comprises 120 wire-per-inch stainless steel wire mesh and is provided along an internal surface or internal diameter 44 of the heat pipe 28. The wire mesh 40 provides an even distribution of additional surface area for evaporation of liquid ammonia. Thus, those skilled in the art will appreciate that the end 42 of each heat pipe 28 preferably is coupled to the heat rejector block 30 of a cryocooler unit 24.

As alluded to above, the heat pipes 28 preferably are shaped such that, when the heat pipes 28 are mounted and thermally coupled to a cryocooler unit 24 and related heat dissipation assembly 14, an upper section 46 of the heat pipes 28 forms an angle of approximately 7° with respect to horizontal. This ensures that, even if an HTSC filter system 10 incorporating the heat pipes 28 is installed +/−5° from true, the upper sections 46 of the heat pipes 28 will remain tilted with respect to horizontal. This ensures proper drainage of condensed ammonia from the upper sections 46 of the heat pipes 28.

As further shown in FIG. 2, the heat pipes 28 preferably comprise 0.5 inch diameter stainless steel tubing and have end caps 50 and 52 provided at the respective ends thereof. The end caps 50 and 52 preferably are TIG welded to respective ends of a stainless steel tube 53. In addition, a 0.25 inch diameter pinch off tube 54 is provided at one end of the stainless steel tube 53. When loading the heat pipes 28 with ammonia, one end of the heat pipe 28 is submerged in liquid nitrogen, and condensed ammonia is flowed into the heat pipe 28 through the pinch off tube 54. Preferably, 3.2 grams of ammonia are flowed into the heat pipes 28. Once the condensed ammonia has been deposited within the heat pipe 28, the pinch off tube 54 is pinched to seal the heat pipe 28 and a cap 52 is provided over the corresponding end of the heat pipe 28 to protect the tip 55 of the pinch off tube 54.

Those skilled in the art will appreciate that a heat pipe, such as the heat pipe 28 described herein, is a unique device that can move a large quantity of heat with a very low temperature drop. Indeed, the thermal conductivity of a heat pipe 28 in accordance with the present invention is likely several thousand times that of the best metal heat conductors such as copper, silver or aluminum. It also will be appreciated that a heat pipe, when used in accordance with the present invention, provides a unique heat management tool, as it has no moving parts and is capable of providing silent, reliable, long life operation when used in conjunction with, for example, an HTSC filter system or cellular communication system.

Turning again to FIG. 1, in a preferred form, the HTSC filter system 10 is sealed within a double-walled aluminum canister 60. The double-walled canister 60 protects the HTSC filter system 10 from environmental factors, exposure to sunlight, and vandalism (i.e., gunfire). Once sealed within the double-walled canister 60, the HTSC filter system may be mounted atop a telephone pole or other tower structure as illustrated in FIG. 4.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A tower mountable HTSC filter system comprising:

a cryocooler and dewar assembly, the dewar assembly including a heat-sink whereon a plurality of HTSC filter circuits may be mounted, a heat dissipation assembly, and one or more heat pipes including a heat transfer fluid therein, the heat pipes providing a thermal coupling between said heat dissipation assembly and said cryocooler and dewar assembly, said one or more heat pipes each including a vertical segment and a horizontally offset segment, wherein the horizontally offset segment ensures proper drainage of condensed heat transfer fluid.

2. The tower mountable HTSC filter system of claim 1, wherein said one or more heat pipes each comprises a sealed stainless steel tube, wherein ammonia is the heat transfer fluid.

3. The tower mountable HTSC filter system of claim 2, wherein a stainless steel mesh is provided along an internal diameter of a selected length of an evaporator end of said one or more heat pipes.

4. The tower mountable HTSC filter system of claim 1, wherein said cryocooler and dewar assembly is environmentally sealed within a double-walled aluminum canister, and said heat dissipation assembly is located external to said double-walled aluminum canister.

5. An HTSC filter system comprising:

a dewar assembly including a heat-sink whereon a plurality of HTSC filter circuits may be mounted, a Stirling cycle cryocooler having a cold finger that is thermally coupled to said heat-sink, a housing providing a sealed enclosure for said dewar assembly and cryocooler, a heat dissipation assembly mounted external to said housing, and at least one heat pipe for providing a thermal coupling between said heat dissipation assembly and a heat rejector block provided on an external section of said cryocooler.

6. A tower mountable HTSC filter system comprising:

a cryocooler and dewar assembly, a heat dissipation assembly, and one or more heat pipes providing a thermal coupling between said heat dissipation assembly and said cryocooler and dewar assembly, wherein said cryocooler and dewar assembly is environmentally sealed within a double-walled aluminum canister, and said heat dissipation assembly is located external to said double-walled aluminum canister.

7. A tower mountable HTSC filter system according to claim 1, wherein the HTSC filter system is mounted to a tower.

8. A tower mountable HTSC filter system according to claim 1 further comprising a heat rejection block provided externally of the cryocooler.

9. A tower mountable HTSC filter system according to claim 1, wherein the heat dissipation assembly comprises a base plate and fins.

10. A tower mountable HTSC filter system according to claim 1 further comprising a screened enclosure including one or more fan units, the screened enclosure covering the heat dissipation assembly.

11. A tower mountable HTSC filter system according to claim 1, wherein the horizontally offset segment of the one or more heat pipes is offset between 0° and approximately 7° from horizontal.

12. An HTSC filter system according to claim 5 further including a tower, wherein the HTSC filter system is mounted on the tower.

13. An HTSC filter system according to claim 5, the heat dissipation assembly further comprising a base plate and fins.

14. An HTSC filter system according to claim 5, wherein the housing is a double-walled aluminum cylindrical container.

15. An HTSC filter system according to claim 5 further comprising a screened enclosure including one or more fan units, the screened enclosure covering the heat dissipation assembly.

16. An HTSC filter system according to claim 5, wherein the at least one heat pipe includes a vertical segment and a horizontally offset segment, wherein the horizontally offset segment ensures proper drainage of a condensed heat transfer fluid.

17. A tower mountable HTSC filter system according to claim 16, wherein the horizontally offset segment of the one or more heat pipes is offset between 0° and approximately 7° from horizontal.

18. A tower mountable HTSC filter system according to claim 6, wherein the heat dissipation assembly comprises a base plate and fins.

19. A tower mountable HTSC filter system according to claim 6 further comprising a screened enclosure including one or more fan units, the screened enclosure covering the heat dissipation assembly.

20. A tower mountable HTSC filter system according to claim 6, wherein the at least one heat pipe includes a vertical segment and a horizontally offset segment, wherein the horizontally offset segment ensures proper drainage of a condensed heat transfer fluid.

21. A tower mountable HTSC filter system according to claim 20 wherein the horizontally offset segment of the one or more heat pipes is offset between 0° and approximately 7° from horizontal.

* * * * *

UNITED STATES PATENT AND TRADEMARK OFFICE
Certificate

Patent No. 6,112,526 Patented: September 5, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Daqvid Chase, Santa Barbara, CA; Mark Hanes, Goleta, CA; Wallace Y. Kunimoto, Santa Barbara, CA; and Amr H. O'Baid, Goleta, CA.

Signed and Sealed this Fourth Day of September 2001.

HENRY BENNETT
*Supervisory Patent Examiner*
Art Unit 3749

UNITED STATES PATENT AND TRADEMARK OFFICE
Certificate

Patent No. 6,112,526 Patented: September 5, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: David Chase, Santa Barbara, CA; Mark Hanes, Goleta, CA; Wallace Y. Kunimoto, Santa Barbara, CA; and Amr H. O'Baid, Goleta, CA.

This Certificate supersedes Certificate issued September 4, 2002.

Signed and Sealed this Tenth Day of September 2002.

HENRY BENNETT
*Supervisory Patent Examiner*
Art Unit 3744

UNITED STATES PATENT AND TRADEMARK OFFICE

CERTIFICATE OF CORRECTION

PATENT NO. : 6,112,526
DATED : September 5, 2000
INVENTOR(S) : Chase et al.

It is certified that error appears in the above-identified patent and that said Letters Patent is hereby corrected as shown below:

Column 2,
Line 4, please change “a” to -- an --.

Signed and Sealed this

Third Day of December, 2002

JAMES E. ROGAN
*Director of the United States Patent and Trademark Office*